United States Patent [19]

Arszman

[11] Patent Number: 4,519,315

[45] Date of Patent: May 28, 1985

[54] FIRE AND FORGET MISSILES SYSTEM

[75] Inventor: Jerrold H. Arszman, Huntsville, Ala.

[73] Assignee: The United States of America as represented by the Secretary of the Army, Washington, D.C.

[21] Appl. No.: 450,874

[22] Filed: Dec. 20, 1982

[51] Int. Cl.[3] ..... F42B 15/00

[52] U.S. Cl. ..... 102/377

[58] Field of Search ..... 89/1.816; 102/348, 374, 102/377, 378, 379, 384, 386, 387, 388

[56] References Cited

U.S. PATENT DOCUMENTS

| | | | |
|---|---|---|---|
| 2,787,218 | 4/1957 | Anthony | 102/377 |
| 3,439,613 | 4/1969 | Thomanek | 102/374 |
| 3,867,893 | 2/1975 | Saholt et al. | 102/378 |
| 4,160,415 | 7/1979 | Cole | 102/475 |
| 4,327,884 | 5/1982 | Lawhorn | 102/374 |

*Primary Examiner*—Charles T. Jordan

*Attorney, Agent, or Firm*—Anthony T. Lane; Robert P. Gibson; Harold W. Hilton

[57] ABSTRACT

A free flight, impulse controlled missile system for directing a warhead to a target. The system includes a small diameter weapon which relies on an accurate ballistic delivery to a point and attitude in space and a body fixed sensor for initiating a self forging fragmentation (SFF) warhead above a target such as a tank.

1 Claim, 5 Drawing Figures

FIRE AND FORGET MISSILES SYSTEM

DEDICATORY CLAUSE

The invention described herein may be manufactured, used, licensed by or for the Government for governmental purposes without the payment to me of any royalties thereon.

BACKGROUND OF THE INVENTION

Many weapon systems presently use some elements of active guidance, shaped charge warheads, and frontal attack and also require man interaction until missile impact. The system of the present invention is fire-and-forget and, therefore, no man interaction until missile impact is required. Additionally, the target (such as a tank) is attacked from the top, which requires less penetration, with a self forging fragmentation warhead (SFF) instead of a shaped charge warhead.

SUMMARY OF THE INVENTION

A lightweight, fire and foreget weapon system which utilizes a man tansportable shoulder fired launcher for firing a missile to a target. An impulse controlled motor delivers a programmed quantity of impulse for range control of the missile. The motor is in front of the warhead and pulls the warhead. At a predetermined time, the motor is separated from and pulls away from the payload. The payload continues in a ballistic trajectory until an asymmetric drag spoiler is deployed at a time preset at launch. The payload then continues to descend in a spiral motion imparted by the asymmetric drag device. A body fixed sensor acquires the target and provides a signal for firing the warhead.

DESCRIPTION OF THE PREFERRED EMBODIMENT

Figure 1:
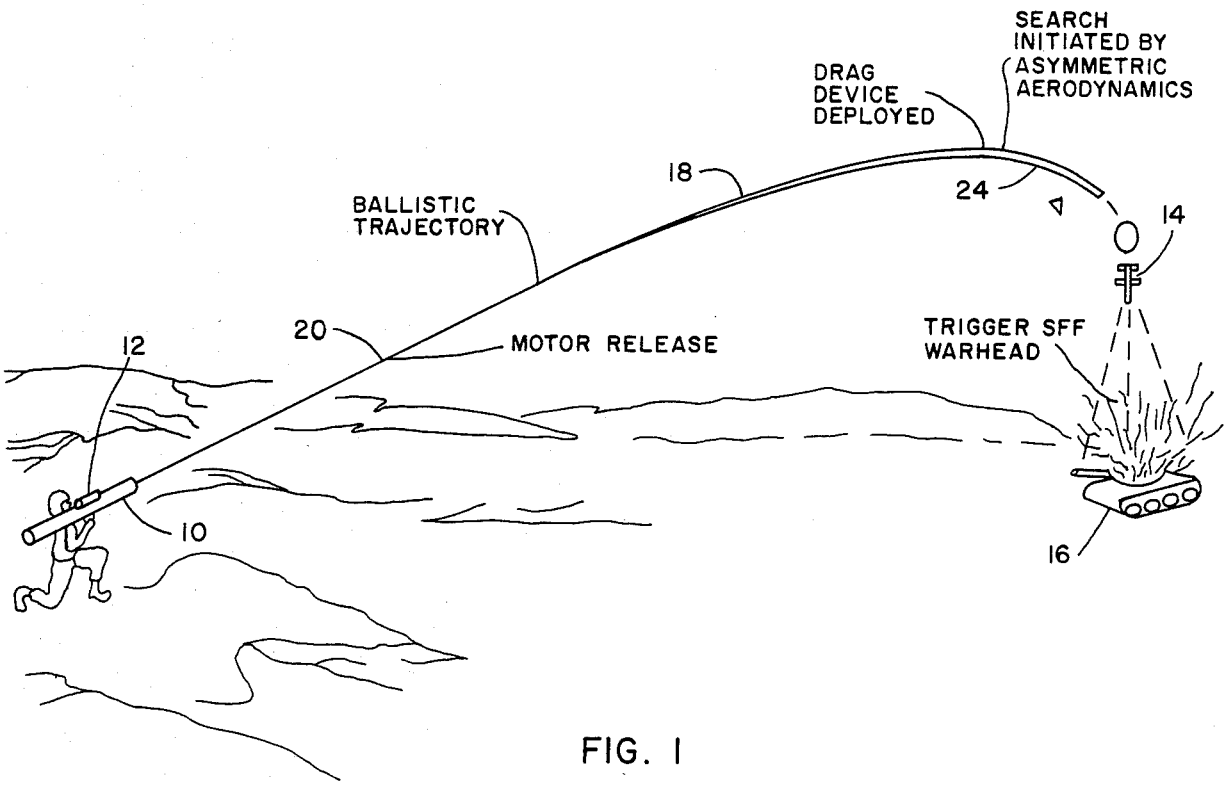
FIG. 1 diagrammatically illustrates the operational sequence of the weapon system of the present invention in its trajectory from launch to target attack.

As seen in FIG. 1, a launcher 10 including a rangefinder 12 is shoulder mounted by an individual for firing a missile 14 to a target 16 in a ballistic trajectory denoted by the numeral 18. The trajectory includes a point 20 where the motor 22 (FIG. 2) is released and a point 24 where a drag device 26 is deployed.

Figure 2:
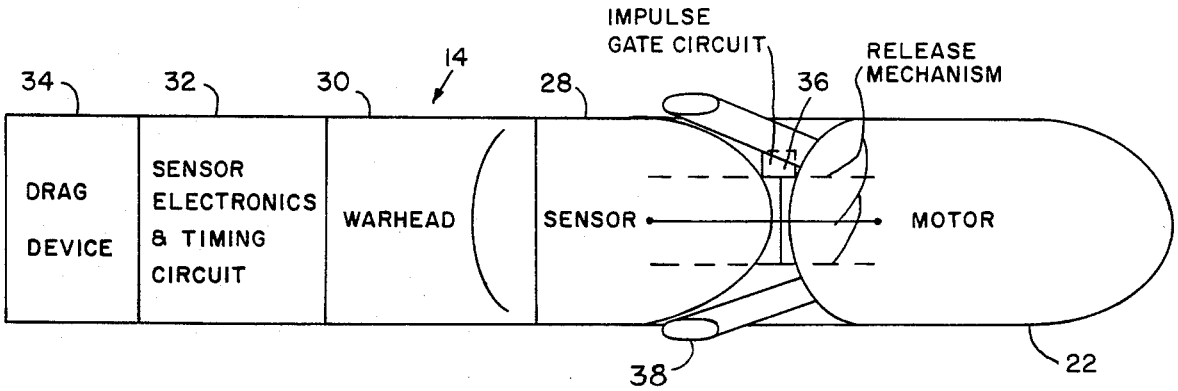
FIG. 2 is a diagrammatic illustration of the missile as used in the system.

As seen in FIG. 2, missile 14 is provided with motor 22 at the forward section thereof. A body fixed sensor 28 is located between motor 22 and a warhead 30. An electronics section 32 for sensor 28 is positioned between warhead 30 and a drag device 34. An impulse gate 36 is provided for initiating release of motor 22 and drag spoiler 34 at points 22 and 24 in the trajectory.

Motor 22 includes nozzles 38 directed outwardly from missile body 14 to direct propulsive gases away from the missile body.

Figure 5:
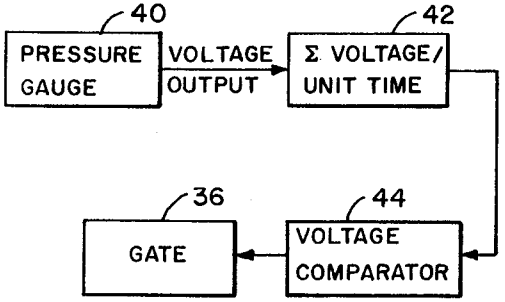
FIG. 5 is a diagrammatic view of the impulse gate used to release the motor and release a drag spoiler at predetermined points in the trajectory.

As seen in FIG. 5, the circuit for activating the impulse gate may include a pressure gage 40 having a voltage output directed to a summation device 42. A voltage comparator 44 receives the output from summation device and sends a signal to impulse gate 36 for activation thereof. Activation occurs when the summation of voltage/unit time value approximately equals a set value. Any well known threshold device can be used as the voltage comparator. Also, any well known summation or integrating circuits may be used for the summation device.

Figure 4:
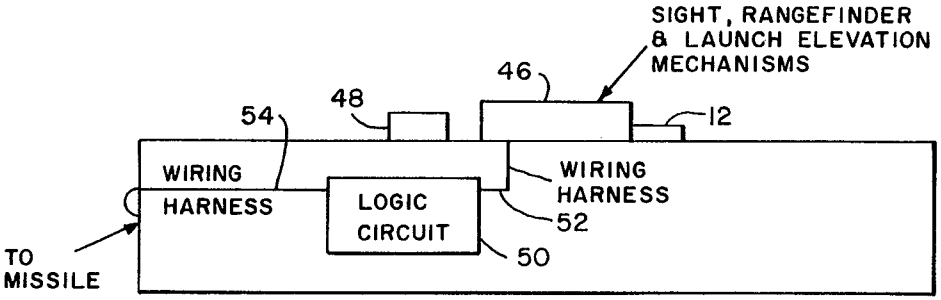
FIG. 4 is a diagrammatic view illustrating a type of launcher as used in the weapon system of the present invention.

FIG. 4 illustrates a type of launcher 10 which may be used to propel the missle to a target. The launcher includes rangefinder 12 and sight and elevation mechanisms 46 and a firing button 48. The sight and launch elevation mechanisms 46 and rangefinder 12 is connected to a logic circuit 50 through a wiring harness 52. The logic circuit is connected to the missile through a wiring harness 54 to preset the necessary information therein.

Figure 3:
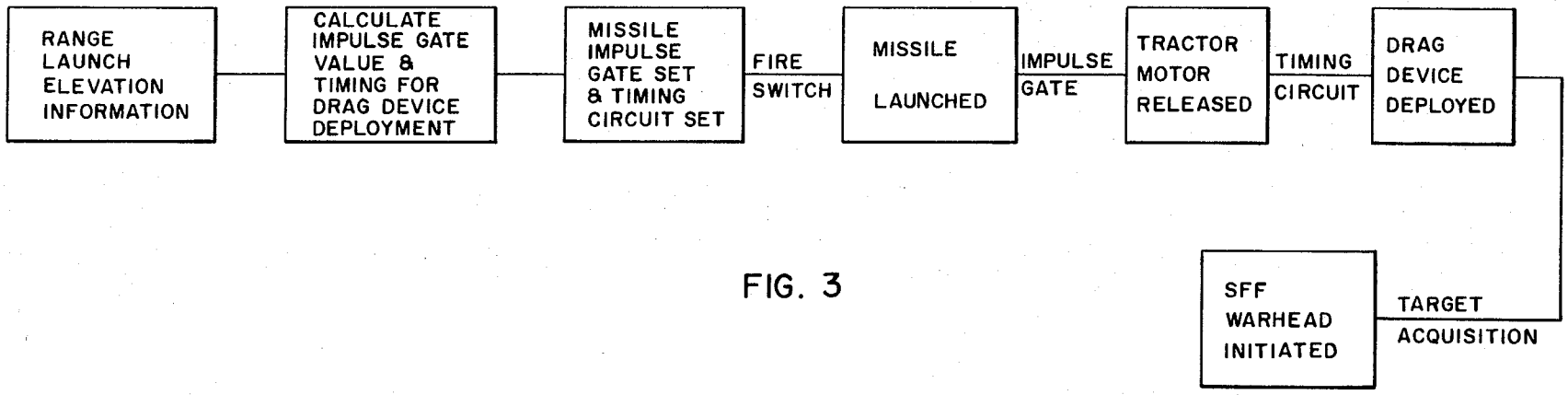
FIG. 3 is a block diagram of the event sequence of events of the weapon system of the present invention.

FIG. 3 is a block diagram which illustrates the event sequence of the weapon system of the present invention.

In operation, the operator locates the target and a rangefinder 12 (such as a laser) determines the range of the target. The launch QE may be zoned to provide some tactical flexibility, but fine tuning of the range is provided by a logic circuit located on the launcher that calculates the desired motor impulse as a function of range and launch QE. This information is fed thru a wiring harness to a timing circuit and impulse gate located on the flight vehicle.

After low-velocity launch, the missile trajectory is controlled by an impulse gate located on the tractor motor. Rather than placing the playload in front of the flight motor as is normally done, the tractor motor is placed in front of the payload and pulls the payload (thus, the name tractor motor). This arrangement allows a clean separation of the payload as soon as the required impulse is delivered. The motor delivered impulse may be determined by an on-board chamber pressure integrator (a combination of a pressure gage and a timing circuit) or a temperature corrected timing circuit operating independent of chamber pressure. The separation event is triggered when the impulse value programmed at launch is reached. At separation signal, the trigger release mechanism (which may be spring loaded, electromechanical, explosive, or a combination) functions, and the tractor motor flys away from the payload which then continues on a low drag, ballistic trajectory to summit.

This flight motor impulse gate and a timing circuit, coupled with the accurate ranging and launch elevation information, control the missile trajectory which places the missile at a point and attitude in space while flying a minimum time, low drag ballistic trajectory to summit. The launch QE at maximum desired range is kept to a minimum to reduce yaw inaccuracies and the time of flight. Shorter ranges will require larger elevations and the possibility to adverse yaw influences; however, dispersion at shorter ranges is less critical in achieving the necessary search footprint.

At ballistic summit, a timing circuit deploys drag spoiler 34 to attain sufficient dwell time and attack angle for target engagement below 100 m altitude. This drag spoiler may be in the form of a traditional ballistic parachute or air foil. An aerodynamically induced coning, which can be achieved by any number of aerodynamic asymmetries ranging from dropping a stabilizing fin to asymmetrical drag spoilers, combines with range closure to provide the required spiral search pattern. At target detection, the sensor triggers the SFF warhead to defeat the target from a standoff of 100 m or less without the necessity of a direct hit missile, FIG. 1.

The sensor is required to detect a target within the search field-of-view, verify the target, and provide the firing command to the SFF warhead. The SFF warhead is an on-axis full diameter charge effective within 100 m of the target. This is in contrast to many other concepts that align the SFF axis at near perpendicular angles to the missile centerline. The warhead firing signal is supplied by the sensor that is essentially co-aligned with the warhead and uses fixed warhead/sensor geometry to increase reliability and reduce mass and cost. The sensor structure in the path of the warhead has been minimized by separating the sensor electronics from the sensing elements and placing the massive sensor electronics behind the warhead. Therefore, the sensor structure will not affect the SFF performance. Several sensor options may be resorted to. A passive (two color infrared) or an active (millimeter wave) sensor may be utilized. Any sensor that can perform its sensing mission without significantly affecting the SFF warhead operation may be resorted to.

The sensor relies on the motion of the missile airframe to provide the search geometries and scan patterns thereby allowing the sensor to be body-fixed. This body fixed sensor technique eliminates the need for a gimbal and servo drive mechanism resulting in a significant weight reduction over a conventional gimballed seeker. The structure in front of the warhead is also minimized by physically dividing the sensor into two parts with the electronics and battery located behind the warhead and the sensing element located in front of or along side the warhead body. A millimeter wave sensor is an example of an active sensor that can be integrated into this system. The antenna section may consist of a reflector plate, an offset feed and a radome. Materials for the reflector plate may include a styrofoam base structure with aluminized surface. The radome can be constructed of a thin wall low RF loss material such as rexolite. The antenna materials and feed location are selected to provide minimum blockage to the warhead. A two-color infrared sensor is an example of another type of sensor that can be used in this system. The sensing elements are small diameter components that are mounted along the skin of the warhead; and, like the active MMW system, the required electronics is packaged behind the warhead.

This system uses a vehicle such as a missile or projectile which is not required to impact with target. When the missile flys over the target and the tank turret enters a "window", a reflected return of transmitted energy is sensed by the receiver, detected by the receiver electronics which initiates a warhead trigger or detonating signal.

The terminal ballistics merely need to place the payload at a point in space within approximately 100 meters of the target. The SFF warhead will then defeat the armored target from the top aspect without the necessity of a direct hit thereby greatly reducing the end game guidance and control required for a direct hit warhead. Some effectiveness in a direct fire mode against alternate targets will be provided by some minor warhead modifications. An impact switch combined with some additional warhead event modes may offer residual capability against bunkers and walls which require direct hit by high explosives.

I claim:

1. A light weight fire and forget weapon system comprising:

a. a shoulder held man transportable rocket launcher for launching a self forging fragment (SFF) warhead in a ballistic trajectory over a target, said launcher having a rangefinder carried thereon for determining the range to said target;

b. a missile carried in said launcher for delivering said warhead to said target, said missile including an impulse motor mounted at the forward end thereof and disposed for separation therefrom at a predetermined point in the trajectory, whereby said warhead continues in a ballistic trajectory after separation of said motor;

c. a body fixed sensor means located intermediate said motor and said warhead for detecting said target and for initiating warhead firing at a predetermined distance above said target;

d. drag spoiler means carried on the aft end of said missile and sensor electronics means carried intermediate said warhead and said drag spoiler means; and, e. means for separating said motor and for deploying said drag device at predetermined points in the trajectory, said means including a gate circuit operatively connected through a voltage comparator and summation device to a pressure gauge in said motor, whereby responsive to actuation of said gate circuit at predetermined points in the trajectory said motor is separated and said drag device is deployed.

* * * * *